United States Patent [19]

Perry

[11] Patent Number: 4,638,530

[45] Date of Patent: Jan. 27, 1987

[54] TOOL CARRIER

[76] Inventor: Roger A. Perry, 15 Pruett Pl., Oakdale, Conn. 06370

[21] Appl. No.: 310,044

[22] Filed: Oct. 9, 1981

[51] Int. Cl.[4] ..... A44B 21/00

[52] U.S. Cl. ..... 24/3 L; 224/904

[58] Field of Search ..... 24/3 U, 3 L, 3 B; 248/311.2, 312; 224/904

[56] References Cited

U.S. PATENT DOCUMENTS

| | | | |
|---|---|---|---|
| 1,326,887 | 12/1919 | Wood | 224/904 |
| 1,600,193 | 9/1926 | Michaud | 224/904 |
| 2,628,054 | 2/1953 | Fazakerley | 248/311.2 |
| 2,894,119 | 7/1959 | Stenger | 248/311.2 |
| 3,104,434 | 9/1963 | Noordhoer | 224/904 |
| 3,599,847 | 8/1971 | Danielson | 224/904 |

FOREIGN PATENT DOCUMENTS

| | | | |
|---|---|---|---|
| 2821442 | 11/1979 | Fed. Rep. of Germany | 24/3 L |

*Primary Examiner*—Gene Mancene
*Assistant Examiner*—Cary E. Stone
*Attorney, Agent, or Firm*—A. W. Hilburger

[57] ABSTRACT

A tool carrier for suspending a hammer from a person's belt. The head of the hammer is supported on a cradle which generally lies in a plane of the person's hand when his arm is relaxed at his side, and the handle of the hammer extends downwardly through an opening in the cradle. The carrier can be readily attached to the belt by sliding a mounting element upwardly behind the belt, then downwardly, so that the belt can be received into a retention slot. A reverse procedure is followed to remove the carrier from the belt. The carrier can be molded or formed out of sheet material or from wire stock.

5 Claims, 13 Drawing Figures

TOOL CARRIER

BACKGROUND OF THE INVENTION

1. Field of the Invention

The present invention relates generally to improved apparatus in the form of a tool carrier for suspending a hammer, ready for use, from a person's belt.

2. Description of the Prior Art

Over the years, numerous expedients have been devised for supporting tools and the like on the belt of the user. Typical of such expedients are the constructions disclosed in the U.S. patents to Wood, U.S. Pat. No. 1,326,887 issued Dec. 30, 1919 and to Noordhoek, U.S. Pat. No. 3,104,434 issued Sept. 24, 1963. Each of these patents discloses hammer hangers formed from wire to hold the head of a hammer at a location contiguous to the belt of the user. The patent of Vanish, U.S. Pat. No. 2,618,419 issued Nov. 18, 1952 discloses a variation of the Wood and Noordhoek constructions. Specifically, the Vanish patent discloses a hammer holster utilizing a coiled wire loop member in combination with a clasp member for holding the head of a hammer at a location contiguous with the belt of the user.

The patents to Langbehn, U.S. Pat. No. 3,508,691 issued Apr. 28, 1970 and to Joliot, U.S. Pat. No. 3,777,933 issued Dec. 11, 1973 both disclose devices for holding items other than hammers at a person's belt. The former discloses a belt tape reel holder while the latter discloses a golf ball holder.

These patents are generally representative of the prior art and, although they were advances in the state of the art at the time they were conceived and reduced to practice, there are a number of drawbacks in the construction of each of them which are notable. For example, in some instances, they display constructions which employ sharp points which can dig or gouge into the skin of the user. Also, in many instances, they can easily slip off the belt of the user. In some other instances, the design permits the hammer or other suspended item to apply leverage to the supporting device in such a fashion as to cause discomfort to the user, or even, perhaps, cause damage to the skin of the user. Also, in some instances, the known devices are of a complicated design or utilize materials which are expensive to manufacture and maintain.

SUMMARY OF THE INVENTION

It was with recognition of the need and of the state of the prior art that the present invention was conceived and has been reduced to practice. To this end, the present invention discloses a tool carrier for suspending a hammer from a person's belt. The head of the hammer is supported on a cradle which lies generally in a plane of the person's hand when his arm is relaxed at his side, and the handle of the hammer extends downwardly through an opening in the cradle. The tool carrier can be readily attached to any size belt without having to undo or remove the belt by sliding a mounting element upwardly behind the belt, then downwardly, so that the belt can be received into a retention slot. A reverse procedure is followed to remove the carrier from the belt. The carrier can be molded or formed out of sheet material or from wire stock.

The present invention, as disclosed, is lightweight, portable, readily usable, employs existing and inexpensive materials, and is of simplified construction. It can be easily attached to a person's belt and subsequently removed and, furthermore, can accept a variety of sizes of hammers. The head of the hammer is supported generally in the plane of the user's hand when the user's arm is relaxed at his side. Thus, it is convenient and comfortable for the user. There are no sharp edges or corners which can cut or gouge the skin of the user and comfort is also achieved for the user by reason of the fact that the head of the hammer is suspended from a distance below a plane of the belt, not held adjacent to the belt as in a number of instances known to the prior art. Yet another benefit of the invention resides in the construction of the invention which insures against the tool carrier being inadvertently detached from the user's belt. This is achieved by locating the opening into the belt receiving slot forward of the rear member of the mounting means and positioning that rear member between the person's body and his belt when the tool carrier is in its operational position.

Other and further features, objects, advantages, and benefits of the invention will become apparent from the following description taken in conjunction with the following drawings. It is to be understood that both the foregoing general description and the following detailed description are exemplary and explanatory, but are not restrictive of the invention. The accompanying drawings, which are incorporated in and constitute a part of the invention, illustrate several embodiments of the invention, and together with the description, serve to explain the principles of the invention.

DETAILED DESCRIPTION OF THE DRAWINGS

Figure 4:
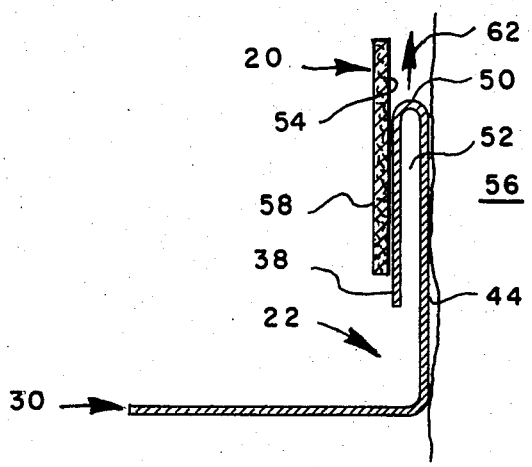
Figure 5:
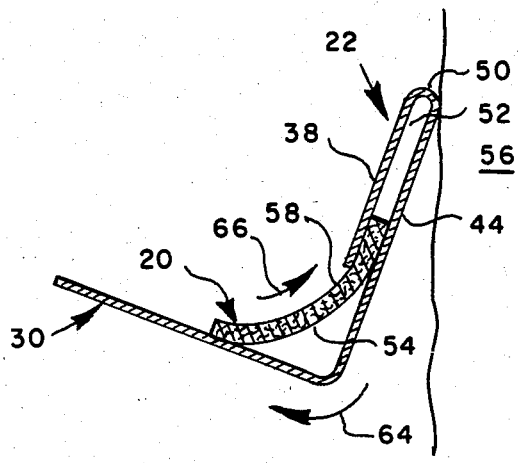
Figure 6:
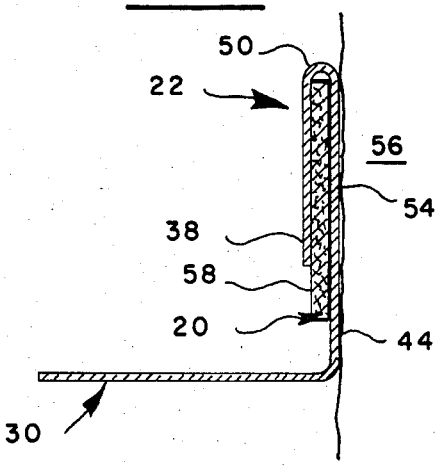
Figure 7:
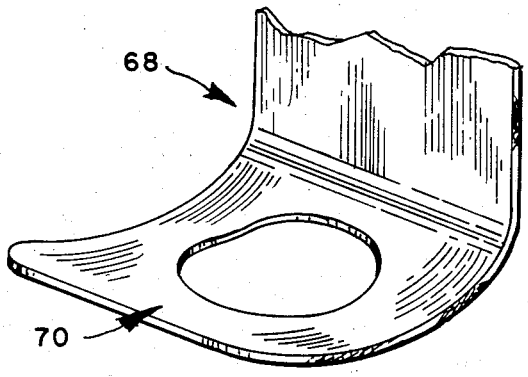

FIGS. 4, 5, and 6 are side elevation views, partly in section, illustrating the steps involved in attaching the invention to the belt of the user;

FIG. 7 is a perspective view of a portion of a modified form of the invention; and FIGS. 8–13 are perspective views of various other modified forms of the invention.

DESCRIPTION OF THE PREFERRED EMBODIMENTS

Figure 1:
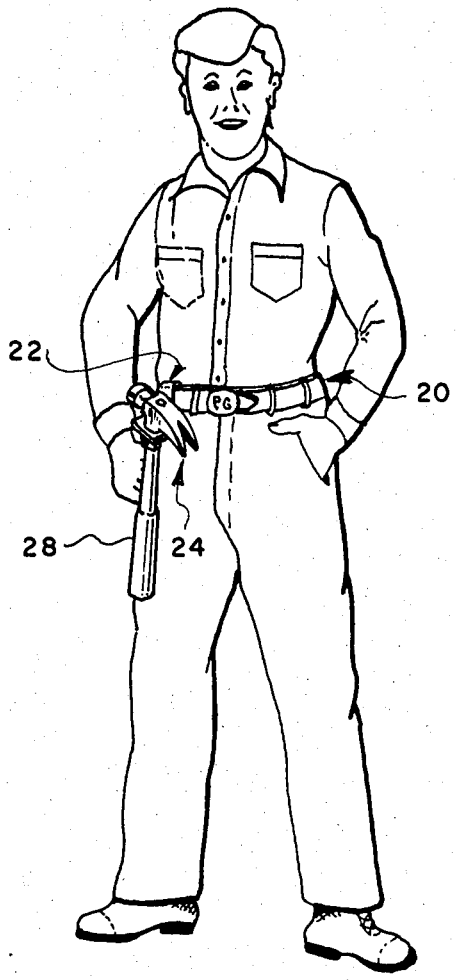
FIG. 1 is a pictorial representation of a person utilizing a tool carrier embodying the principles of the present invention.

Refer now to the drawings, and initially to FIG. 1 which illustrates a person wearing a belt 20 to which is attached a tool carrier 22 embodying the principles of the present invention. As seen in FIG. 1, and with greater detail in FIG. 2, the tool carrier 22 serves to suspend, from the person's belt 20, a hammer 24 of the common type having a head 26 with two ends and a handle 28 extending transversely of the head from a location intermediate the ends of the head.

In accordance with the invention, the apparatus being disclosed as the invention comprises a cradle including a base for supporting at spaced locations the head of the hammer and having an opening adapted to freely receive therethrough the handle of the hammer; and mounting means for releasably suspending said cradle from a person's belt such that when the head of the hammer is supported on said cradle, the head lies in a plane beneath the plane of the belt, said mounting means including at least one forward member having upper and lower ends and at least one associated rear member having upper and lower ends, said forward and rear members lying in spaced apart generally parallel planes, bridge means joining said forward and rear members at said upper ends, said forward and rear members defining a belt receiving slot therebetween such that when said tool carrier is in its operational position, said rear member lies between the inside surface of the belt and the person's body and said forward member lies contiguous to the outer surface of the belt; said cradle being joined to said rear member at said lower end thereof and lying in a plane generally transverse of said rear member, said forward member terminating above said cradle a distance generally equivalent to the width of the belt to enable the belt to be received in the belt receiving slot between said forward and rear members.

Figure 2:
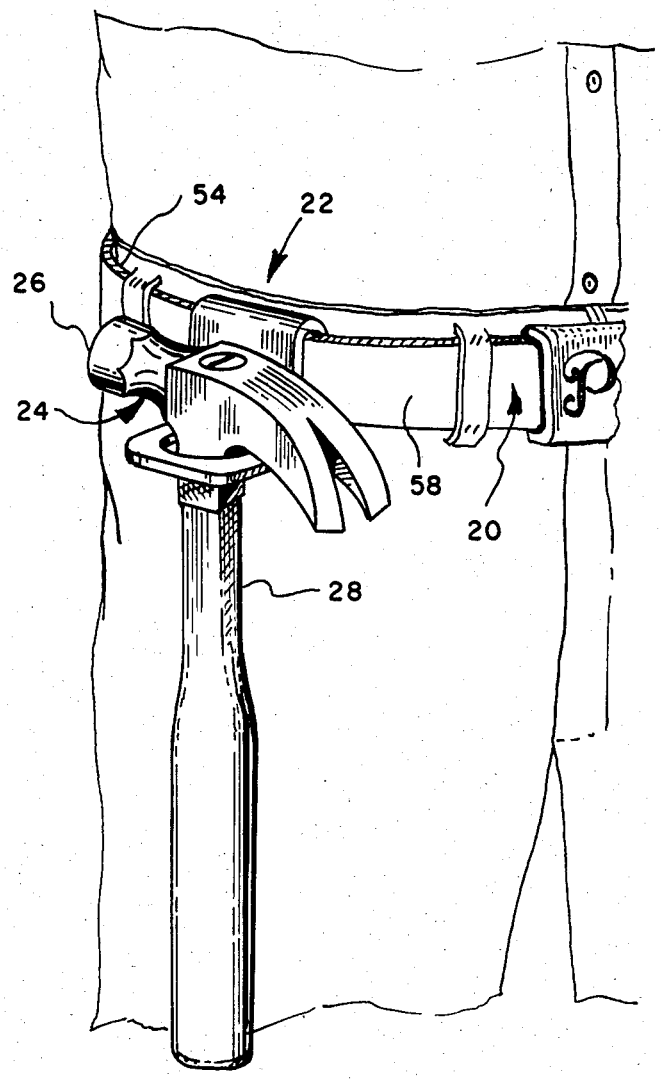
FIG. 2 is a perspective view of the embodiment of the invention illustrated in FIG. 1 and illustrating it in use attached to the belt of a user and supporting a hammer ready for use.
Figure 3:
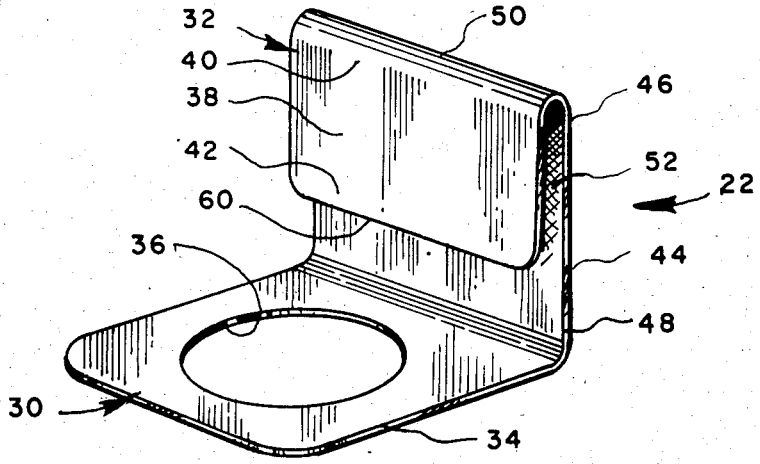
FIG. 3 is a perspective view of the embodiment of FIGS. 1 and 2 by itself.

As embodied herein, with reference now especially to FIG. 3, the tool carrier 22 is seen to include a cradle 30 and mounting means 32 for releasably suspending the cradle from a person's belt 20 (see FIG. 2) such that when the head 26 of the hammer 24 is supported on the cradle 30, the head lies in a plane beneath the plane of the belt. Such positioning is most clearly seen in FIGS. 1 and 2. With continuing reference to FIG. 3, the cradle 30 is seen to include a base 34 for supporting the head 26 of the hammer 24 at spaced locations (see FIG. 2) and having an opening 36 adapted to freely receive therethrough the handle 28 of the hammer 24.

The mounting means 32, as seen in FIGS. 2 and 3, include a forward member 38 having an upper end 40 and a lower end 42. The mounting means 32 also includes an associated rear member 44 which lie is spaced apart, generally parallel, planes and are joined at their upper ends, 40 and 46, respectively, by an integral bridge member 50. A slot 52 is defined between the forward member 38 and the rear member 44 and serves to receive the belt 20 in such a fashion that when the tool carrier is in its operational position (see FIG. 2), the rear member 44 lies between an inside surface 54 of the belt 20 and a body 56 of the person utilizing the tool carrier. Also, in the operational position of the tool carrier 22, the forward member 38 lies contiguous to an outer surface 58 of the belt 20.

The cradle 30 is joined to the rear member 44 at its lower end 48 and lies in a plane generally transverse of the rear member. As seen with particular clarity in FIGS. 2 and 3, the forward member 38 terminates well above the cradle. The distance between a lower edge 60 (see FIG. 3) and the base 34 is preferably equivalent to the width of the belt 20 so as to enable the belt to be easily received within the slot 52.

The procedure of attaching the tool carrier 22 to the belt 20 is illustrated, in successive steps, in FIGS. 4, 5, and 6. In FIG. 4, the tool carrier 22 is inserted from beneath the belt 20 between the belt and the person's body 56, then pushed upwardly in the direction of an arrow 62. Then, viewing FIG. 5, with the bridge means 50 pressing against the person's body 56, the tool carrier 22 is rotated in the direction of an arrow 64 so that the belt 20 is received within the slot 52. In the course of this step, the belt 20 is moved upwardly into the slot in the direction of an arrow 66. In the final position of the tool carrier 22, ready for operation (see FIG. 6), the belt 20 is fully received within the slot 52 such that its upper edge terminates adjacent the bridge member 50. At this stage, the tool carrier 22 is ready for reception of the hammer 24 as illustrated in FIG. 2.

Of course, although the procedure illustrated in FIGS. 4–6 suggests insertion of the tool carrier from beneath the belt, the tool carrier can also be inserted from above the belt, the cradle 30 being inserted first between the belt and the person's body 56.

The tool carrier 22 illustrated in FIGS. 1, 2, and 3 may be molded from sheet material, whether metal, plastic, glass fiber, or other suitable material or stamped out of such sheet material, or fabricated in any other suitable fashion.

Figure 8:
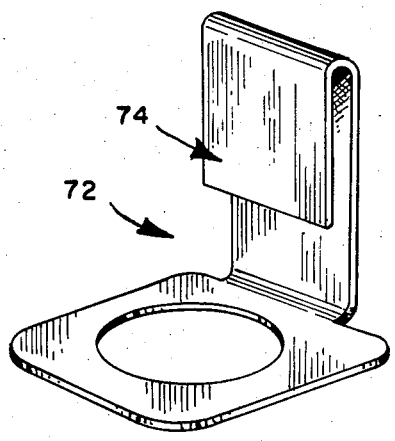

FIG. 7 illustrates a modified tool carrier 68 which is similar to the tool carrier 22 except for a cradle 70 which is formed in an arcuate or concave manner so that the cradle conforms more nearly to the shape of the hammer 24. Another modified tool carrier 72 is illustrated in FIG. 8, a construction also similar to the tool carrier 22 except that a mounting means 74 is of a narrower construction than the mounting means 32 (see FIG. 3). The tool carrier 72 represents a savings in material necessary for fabrication, and, furthermore, a reduced width of the mounting means 74 would enable the tool carrier 72 to more readily follow the curvature of the belt 20 on which it is to be mounted.

Figure 9:
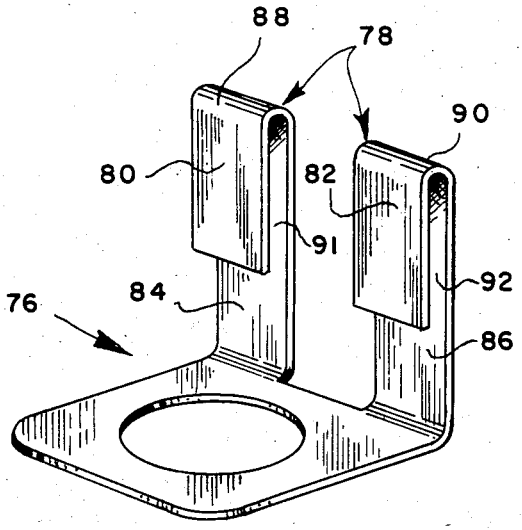

Still another modified tool carrier is illustrated in FIG. 9 and is identified by the reference numeral 76. This construction is also generally similiar to the tool carrier 22 except that it is provided with mounting means 78 which include a pair of forward members 80 and 82, and a pair of associated rear members 84 and 86 and a bridge member 88 joining the associated forward and rear members 80 and 84, respectively, at the upper ends of each, and a bridge member 90 joining the associated forward and rear members 82 and 86, respectively, at the upper ends of each. As with the tool carrier 22, the mounting means 78 define belt receiving slots 91 and 92. As with the tool carrier 72, the tool carrier 76 represents a savings of material in the fabrication process and, by reason of the reduced width of the individual mounting means 78, the tool carrier 76 more readily conforms to the curvature of the belt 20 when the tool carrier is in its operational position.

In accordance with the invention, the tool carrier is generally as previously described wherein said tool carrier is fabricated from a single length of wire having opposed end portions and a central portion, said mounting means being formed from said end portions and said cradle being formed from said central portion.

Figure 10:
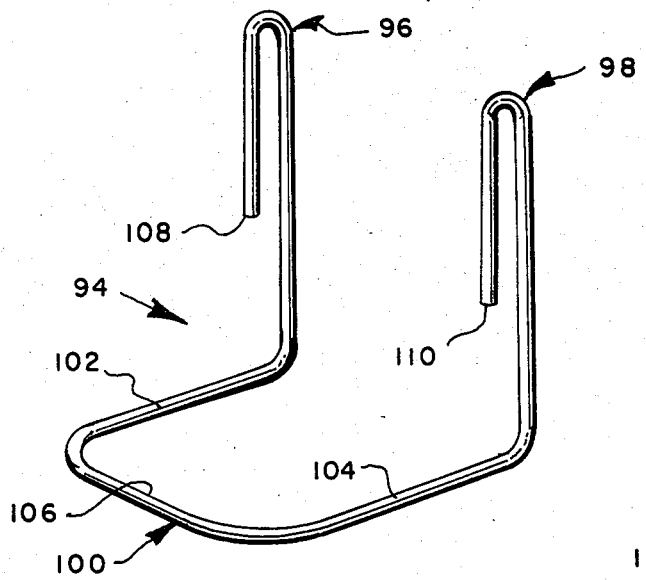

As embodied herein, with reference now being made to FIG. 10, a modified tool carrier 94 is illustrated which is fabricated from a single length of wire. The tool carrier 94 includes a pair of mounting means 96 and 98 which are fabricated from opposed end portions of the wire and a cradle 100 being formed from the central portion of the length of wire. Those portions of the wire indicated at 102 and 104 represent a base for supporting the head 26 of the hammer 24 at spaced locations, the cradle 100 defining an opening 106 through which the handle 28 of the hammer can be inserted. The dimensions of the tool carrier 94 may be similiar to those of the carrier 22. For example, the distance between ends 108 and 110 and their respective portions 102 and 104 would be similiar to the distance between the lower edge 60 and 34 of the former embodiment. However, it will be appreciated that the use of wire instead of sheet material or a molded material would result in a construction which would utilize much less in the way of material and it would be lighter in weight and, generally, easier to store and maintain. At the same time, the tool carrier 94 would have adequate strength to achieve its desired purpose.

Figure 12:
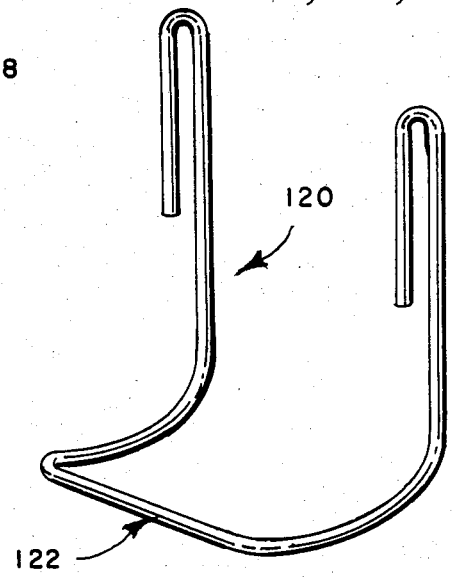
Figure 11:
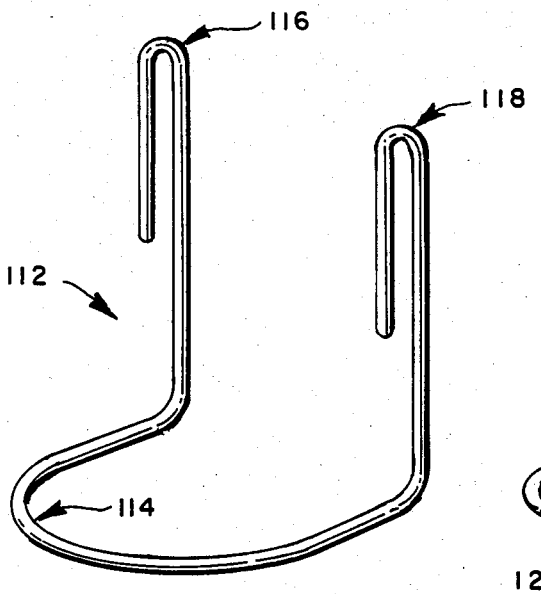

Other modified forms of the invention are illustrated in FIGS. 11 and 12. A modified tool carrier 112 illustrated in FIG. 11 is generally similiar to the tool carrier 94 except that a cradle 114 is curved in a continuous fashion between the bases of mounting means 116 and 118. A modified tool carrier 120 illustrated in FIG. 12 is similiar to both of the carriers 94 and 112, but is formed with a cradle 122 which is generally concave in the manner illustrated.

In accordance with the invention, the tool carrier is generally as previously described wherein said tool carrier is fabricated from a single length of wire having opposed end portions, said mounting means being formed from one of said end portions and said cradle being formed from the other of said end portions.

Figure 13:
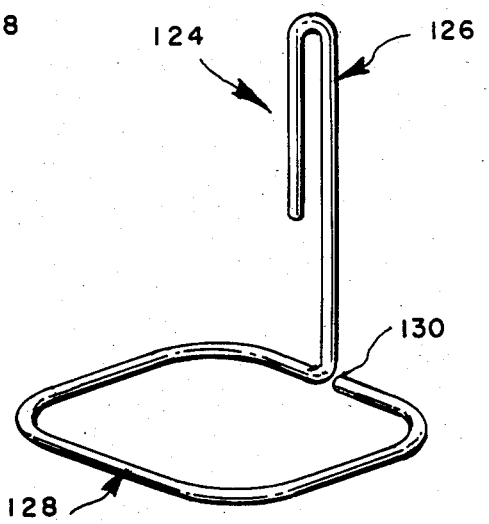

As embodied herein, turning now to FIG. 13, a modified tool carrier 124 is illustrated being fabricated from a single length of wire having opposed end portions. A first end portion is defined by a single mounting means 126 and the opposite end portion is defined by a cradle 128 suitable for supporting the head of the hammer 24 in the manner previously described. An extreme end 130 may remain disengaged from a base portion of the mounting means 126 or may be suitably welded to improve the rigidity of the unit. The benefits of the tool carrier 124 reside primarily in its extreme simplicity and in the resultant use of a minimum amount of material.

The invention in its broader aspects, is not limited to the specific details shown and described; departures may be made from such details without departing from the principles of the invention and without sacrificing its chief advantages.

What I claim is:

1. A tool carrier for suspending from a person's belt a hammer of the type having a head with two ends and a handle extending transversely of the head from a location intermediate the ends of the head comprising:

a cradle including a base for supporting at spaced locations the head of the hammer and having an opening adapted to freely receive therethrough the handle of the hammer; and mounting means for releasably suspending said cradle from a person's belt such that when the head of the hammer is supported on said cradle, the head lies in a plane beneath the plane of the belt, said mounting means including at least one forward member having upper and lower ends and at least one associated rear member having upper and lower ends, said forward and rear members lying in spaced apart generally parallel planes, bridge means joining said forward and rear members at said upper ends, said forward and rear members defining a belt receiving slot therebetween such that when said tool carrier is in its operational position, said rear member lies between the inside surface of the belt and the person's body and said forward member lies contiguous to the outer surface of the belt;

said cradle being joined to said rear member at said lower end thereof and lying in a plane generally transverse of said rear member, said forward member terminating above said cradle a distance generally equivalent to the width of the belt to enable the belt to be received in the belt receiving slot between said forward and rear members.

2. A tool carrier as set forth in claim 1 wherein said carrier is fabricated from sheet material.

3. A tool carrier as set forth in claim 1 wherein said tool carrier is fabricated from a single length of wire having opposed end portions and a central portion, said mounting means being formed from said end portions and said cradle being formed from said central portion.

4. A tool carrier as set forth in claim 1 wherein said tool carrier is fabricated from a single length of wire having opposed end portions, said mounting means being formed from one of said end portions and said cradle being formed from the other of said end portions.

5. A tool carrier for suspending from a person's belt a hammer of the type having a head with two ends and a handle extending transversely of the head from a location intermediate the ends comprising:

a cradle including a base for supporting at spaced locations the head of the hammer and having an opening adapted to freely receive therethrough the handle of the hammer; and mounting means for releasably suspending said cradle from a person's belt such that when the head of the hammer is supported on said cradle the head lies in a plane beneath the plane of the belt, said mounting means including a pair of forward members having upper and lower ends and a pair of associated rear members having upper and lower ends, said forward and rear members lying in spaced apart generally parallel planes, bridge means joining said associated forward and rear members at said upper ends, each of said pair of forward and rear members defining a belt receiving slot therebetween such that when said tool carrier is in its operational position, said rear members lie between the inside surface of the belt and the person's body and said forward members lie contiguous to the outer surface of the belt;

said cradle being joined to said rear members at said lower ends thereof and lying in a plane generally transverse of said rear members, said forward members terminating above said cradle a distance generally equivalent to the width of the belt to enable the belt to be received in the belt receiving slot between said pair of forward and rear members.

* * * * *